US005125200A

United States Patent [19]

Natterer

[11] Patent Number: 5,125,200

[45] Date of Patent: Jun. 30, 1992

[54] BUILT-UP SUPPORT MEMBER

[75] Inventor: Julius Natterer, Etoy, Switzerland

[73] Assignee: Hilti Aktiengesellschaft, Fürstentum, Liechtenstein

[21] Appl. No.: 623,226

[22] Filed: Dec. 4, 1990

[30] Foreign Application Priority Data

Dec. 4, 1989 [CH] Switzerland ..... 04334/89

[51] Int. Cl.[5] ..... E04C 3/22; E04C 3/29; E04C 3/26

[52] U.S. Cl. ..... 52/223 R; 52/327; 52/334; 52/733

[58] Field of Search ..... 52/223 R, 231, 327, 52/333, 334, 351, 733, 414, 453, 612, 368, 369, 309.11, 309.12, 309.17, 723

[56] References Cited

U.S. PATENT DOCUMENTS

| | | | |
|---|---|---|---|
| 1,431,086 | 10/1922 | Ault | 52/723 |
| 3,210,900 | 10/1965 | Sattler | 52/733 |
| 3,397,497 | 8/1968 | Shea et al. | 52/334 |
| 4,333,280 | 6/1982 | Morton | 52/414 |

FOREIGN PATENT DOCUMENTS

| | | | |
|---|---|---|---|
| 546445 | 7/1929 | Fed. Rep. of Germany | 52/334 |
| 19661V/3A | 8/1956 | Fed. Rep. of Germany | 52/327 |
| 667419 | 1/1929 | France | 52/334 |
| 3102 | of 1877 | United Kingdom | 52/327 |
| 473490 | 10/1937 | United Kingdom | 52/327 |
| 784383 | 10/1957 | United Kingdom | 52/334 |

*Primary Examiner*—David A. Scherbel
*Assistant Examiner*—Robert Canfield
*Attorney, Agent, or Firm*—Akoo-Toren

[57] ABSTRACT

A built-up support member for carrying bending loads is used in building construction. The support member is formed of two separate elements (1, 2), one superimposed on the other. The separate elements absorb normal forces caused by bending loads. One of the elements (2), for example formed of concrete, acts in compression, while the other acts in tension. Shear forces must be transmitted between the separate elements. Shear transmission surfaces afford a positively locked connection of the separate elements. The shear transmission surfaces include cooperating and complementary shaped projections and recesses. In addition, clamping elements (15) are provided between the separate elements in a prestressed manner.

9 Claims, 4 Drawing Sheets

FIG. 1
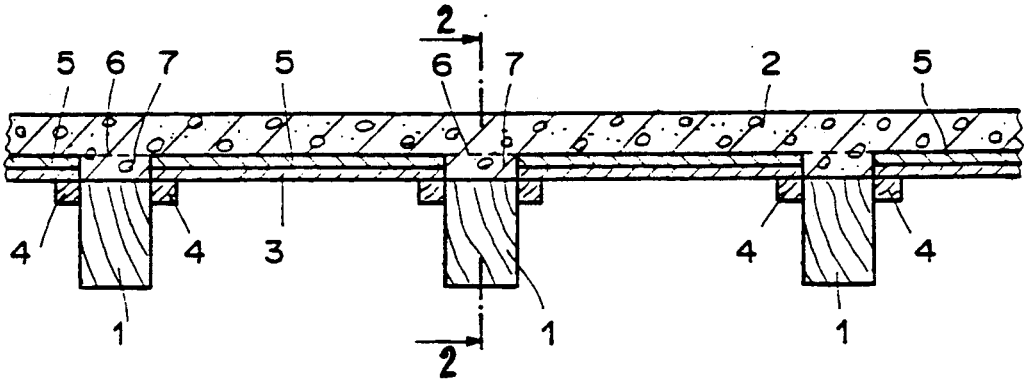
FIG. 2
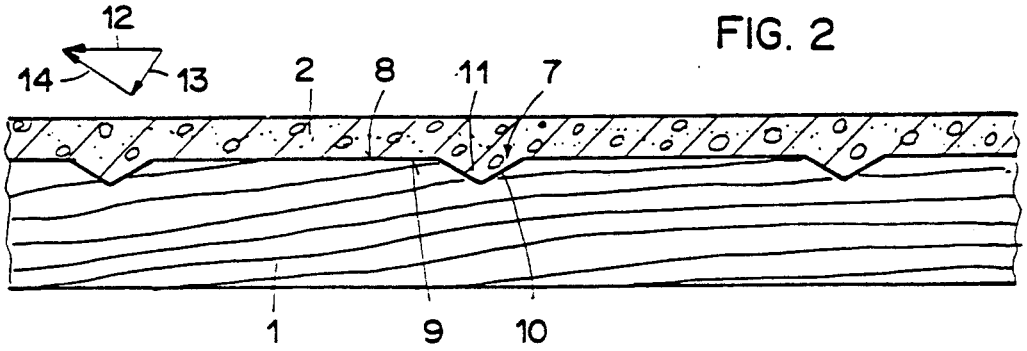
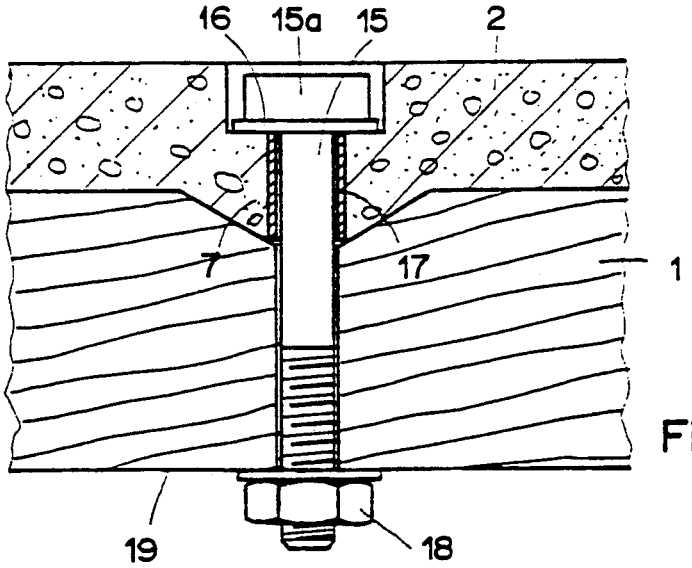
FIG. 3

BUILT-UP SUPPORT MEMBER

BACKGROUND OF THE INVENTION

The present invention is directed to a built-up support member for carrying bending loads and is formed of two coacting load carrying separate elements one superimposed on the other. The separate elements absorb normal forces caused by bending. The separate elements have contacting surfaces and include means for transmitting shear forces acting at the contacting surfaces.

In various types of construction, reinforced concrete elements are often used as load bearing elements, for instance as ceilings, in bridges and in other load bearing structures. In some instances large quantities of concrete are utilized, however, the concrete does not afford any load carrying function, instead it provides protection against corrosion for steel members located inside the concrete. By comparison, lighter members can often be employed and other advantages obtained by the use of built-up load carrying members of equal stiffness. A built-up load bearing support member is formed of at least two separate elements. The separate elements constituting such a built-up support member can be a concrete panel and a timber girder or beam cooperating with the panel. This type of support member is used when bending forces are experienced, whereby the concrete panel carries the compression load and the wooden beam the tensile load. This division of the load involves the development of shear forces between the separate elements of the built-up support member.

Such shear forces must be transmitted by suitable attachment or connecting means. Dowels can be used as shear transmission means, connected into the concrete element and also into the wooden element or beam with the connection to the beam effected by a thread. A large quantity of dowels is necessary for a positively locked transmission of the shear forces acting on the joint between the two elements. If the dowels provide incomplete frictional transmission of the shearing forces, the dowels are stressed in transverse directions and become loosened with the support member experiencing a loss in stiffness.

In another known built-up support member, a diagonal dowel connection has been used where the dowels are arranged sloping relative to the major dimensions of the member. In such an arrangement a large quantity of dowels are necessary, however, the diagonally arranged dowel connection is also prone to loosening. To obtain an improved transmission of the shear forces, positively locked connection between the load bearing separate elements have been known, such as described in the French patent application 2568610.

This known connection has the disadvantage, however, that the vibration which develops in the concrete and wooden elements can result in a loosening of the positively locked connection and results in a considerable loss in stiffness of the built-up support member.

SUMMARY OF THE INVENTION

Therefore, the primary object of the present invention is to provide a built-up support member where shear transmission means between the individual elements are formed so that the disadvantages previously experienced in such built-up members are avoided. In particular, an easily fabricated support member is provided which requires few dowels or other clamping means and retains its high stiffness characteristic even when exposed to vibrations in the wooden element and/or concrete element. In accordance with the present invention, the shear forces are transmitted between the facing surfaces of the separate elements by providing complementary shaped surfaces on the elements formed of projections and recesses. Further, means are arranged for applying compression force between the separate elements with such means extending transversely of the facing surfaces.

The complementary arrangement of the projections and recesses in the facing surfaces of the separate elements of the built-up support element, in combination with a compression force acting perpendicularly to the surface of the panel-like concrete element, affords a prestressed positively locked connection. Accordingly, a redirection of the shear forces in a direction perpendicular to the flanks of the projections and recesses can be achieved between the separate elements. The prestress of the positively locked connection assures that the stiffness of the built-up support member is maintained in the event vibrations develop in the load carrying separate elements.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 1 is a cross sectional view through a first embodiment of a built-up support member incorporating the present invention;

FIG. 2 is a sectional view, through the built-up support member taken along the line 2—2 in FIG. 1, however, for sake of simplicity, the clamping elements have not been shown;

FIG. 3 is an enlarged showing of a part of the section illustrating in the FIG. 2 displaying the individual elements of the support member formed with complementary projections and recesses and showing a clamping element;

DETAILED DESCRIPTION OF THE INVENTION

Figure 4:
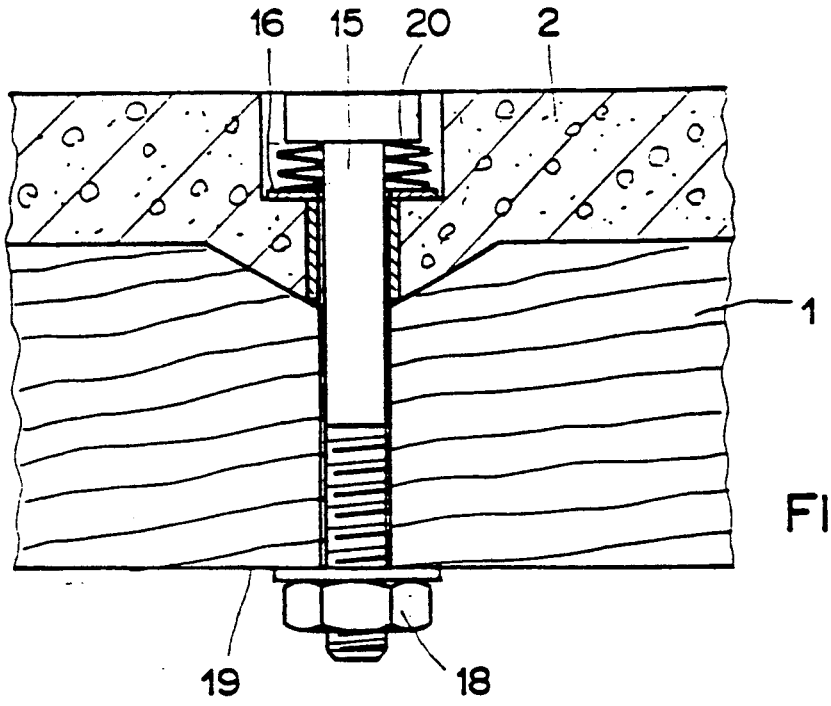
FIG. 4 is a view similar to FIG. 3 through the support member of the present invention where the clamping bolt is prestressed by Belleville springs.

In FIG. 1 a built-up support member embodying the present invention is illustrated. The load carrying support member is formed by two separate elements 1, 2. First separate element 1 is a number of wooden beams and second separate element 2 is a deck or panel-like concrete element. The built-up support member as shown can be used as a ceiling in a building structure. Further, FIG. 1 shows formwork panels or boards 3 attached to the first element 1 by means of dressed timbers 4 providing the formwork for pouring the concrete element 2. In addition, an insulation layer 5 is located over the formwork panels 3 so that the lower surface of the concrete element 2 is defined by the layer 5. The support member, as depicted in FIG. 1, is stressed in bending by its own weight, particularly that of the concrete element 2 as well as any loads acting on the surface of the concrete element. The separate concrete element 2 forming the upper half of the support member carries the compression stresses which develop, while the lower wooden element 1 absorbs tensile stresses occurring as a result of bending loads. Such a built-up or composite design has the advantage that the concrete element 2 is stressed only in compression and, as a result, the concrete does not require any means, such as reinforcement, for carrying tensile stresses. As a consequence of the division of the compression and tension forces between the two elements 1, 2, shearing forces occurring at joint 6 between the separate elements must be transmitted, and such transmission of the shear forces is effected by a positive lock between the elements 1, 2 afforded by the projections 7.

In FIG. 2 a section is shown of the support member taken in the long direction of the wooden beam or element 1 along the line 2—2 as shown in FIG. 1. To increase the transmission of shear forces acting at the joint 6, the cooperating contacting surfaces 8, 9 of the separate elements 1, 2 form a complementary projection-recess arrangement. In the embodiment displayed in FIG. 2, V-shaped projection-recess arrangement 7 is located between the contacting surface 8, 9 of the elements 1, 2. The arrangements 7 are spaced apart from one another in the long direction of the element 1. Contacting surface 8 of the first element 1, shown as a wooden beam, has V-shaped recesses 10 at appropriate locations for receiving the projections 11 on the second element 2. The recesses 10 can be formed by milling. After fabricating the formwork illustrated in FIG. 1, with the possible insertion of an intermediate layer of insulation, concrete is poured over the formwork and after setting or curing, forms the load carrying separate element 2. As the concrete is poured, it fills the recesses 10 in the upper surface of the first element 1 forming the individual projections which are shaped complementary to the recesses 10.

The illustrated recesses 10 and projections 11 between the separate elements 1, 2 causes the shear forces, developed because of bending loads acting on the support member, to be transmitted between the elements, so that a high stiffness of the built-up support member is achieved. In FIG. 2 force vectors 12, 13, 14 are shown to illustrate the mode of operation of the interlocking arrangement of the contacting surfaces 8 and 9 afforded by the complementarily shaped recesses 10 and projections 11. Shear force vector 12 acting between the separate elements 1, 2 is divided in the projections-recesses 11, 10 into a force vector component 13 acting perpendicular to one flank of the recess and another vector component 14 acting parallel to the flank. The force vector component 14 acting parallel to the flank of the recess causes an upward lift on the upper separate element 2. Consequently, a compression force acting on the separate elements 1, 2 is necessary to counteract the upper lift. The required value of this compression force depends upon the dimensions, loads and construction of the built-up support member. If the separate element 2 is formed of concrete, it has a relatively high dead weight so that the required compression force between the separate elements can be supplied by the weight of the concrete element itself. In case of higher stresses or of an upper separate element 2 of insufficient weight; it is necessary to provide a clamping means, not shown in FIG. 2 between the individual elements.

In FIG. 3 a clamping element is shown connecting the individual elements with the element displayed on an enlarged scale as compared to FIGS. 1 and 2. In this FIG. the clamping element is a threaded bolt 15 extending through the concrete element 2 and the wooden beam or element 1. Threaded bolt 15 has a head 15*a* abutting against a recessed surface of the element 2 via a washer 16 and the shank of the bolt is separated by a sleeve 17 from the concrete element 2. This separation is needed to assure that the force introduction occurs in a vertical direction. The remainder of the bolt extends through the element 1 and its threaded end region receives a nut 18 bearing against the lower surface of the element 1 by means of a washer. In addition to the clamping element illustrated in FIG. 3, other embodiments are possible. Accordingly, in place of a bolt head 15*a* separate from the element 2, the clamping element could be concreted into the element. It is also possible that the clamping element, located within the lower element 1, is adhesively secured in a bore in the element. If shear forces develop at the joint between the separation elements 1, 2 and cause upwardly lifting forces, the clamping element is loaded in tension and prevents the upper element 2 from lifting off the lower element 1. This can occur especially if high individual loads act from one side on the built-up support member.

The transmission means between the separate elements 1, 2 are prestressed in another embodiment of the built-up support member of the invention. The nut 18 along with the thread shown in FIG. 3 can be used to produce a prestress. After the concrete forming the upper separate element 2 has set, the bolt can be prestressed by tightening the nut 18. Due to this compressive force, the force vector components act in the unloaded state on the obliquely arranged flanks of the projection-recess 7 so as to act opposite to the force vector components 13, 14 in FIG. 2 acting on a flank of the recess when a load is applied to the support member. In this manner, an increased stiffness of the support member of the present invention is achieved in the loaded state.

Vibrations can develop in the separate elements 1, 2 due to a change of moisture content in the concrete element or the wooden element. In the known composite beams such vibrations result in a high loss of stiffness. The prestress provided by the present invention affords compensation for such vibrations. The prestress can be produced not only by means of the threaded bolt, but by other possible means.

As displayed in FIG. 4, a clamping element can also be tightened by elastic stressing means such as a package of spring washers or Belleville springs 20. With such means a larger elastic travel is afforded, whereby larger amounts of vibration can be compensated without any loss of prestressing force. In addition to the embodiment exhibited in FIG. 4, the elastic stressing means can also be arranged on the lower side 19 of the lower element 1. The elastic stressing means can be provided in the form of Belleville springs, elastic or control springs, and other elastic means. It is also possible to use swelling or expanding substances arranged in the concrete so that after absorbing moisture from the concrete they swell or expand and by means of such expansion a prestressing force is applied to the clamping element.

Figure 5:
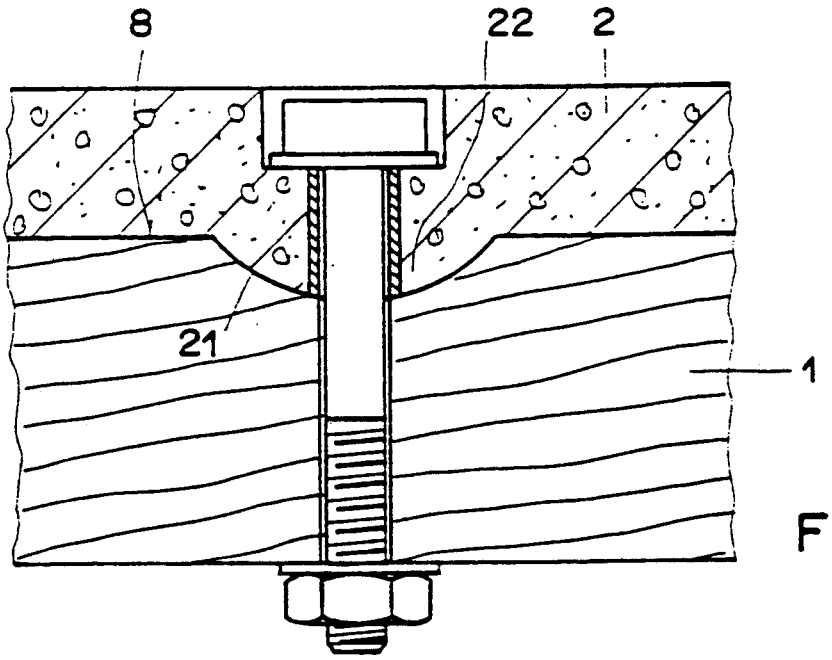
FIG. 5 is a view similar to FIG. 3 showing a second embodiment of a built-up support member incorporating the present invention.

In FIG. 5 another embodiment of the transmission means between the separate elements 1, 2 is illustrated. In this embodiment the contacting surface 8 of the separate element 1 is shaped at certain spaced locations along its length into a rounded recess 21 accordingly with rounded flanks. The positive lock is provided by the rounded recess 21 and a complementary shaped projection 22 on the other separate element 2.

Figure 6:
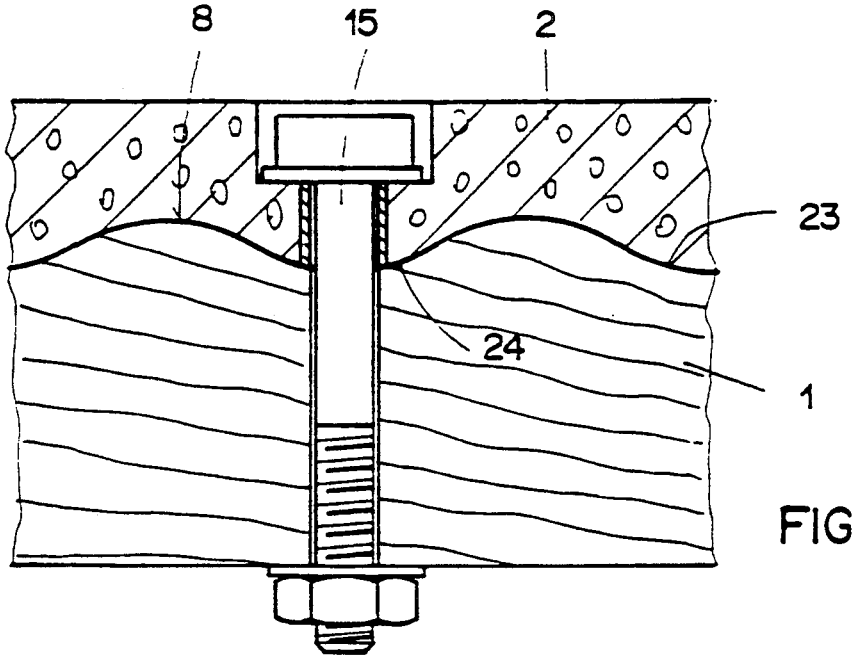
FIG. 6 is a view similar to FIG. 3 illustrating a third embodiment of a built-up support member incorporating the present invention.

As distinguished from the embodiment shown in FIG. 1-3, in FIG. 6 the contacting surface 8 of the wooden beam or element I cooperating with the concrete deck or element 2 is provided with an undulating or wave like profile 23. As a result, the surface 8 has alternating crests and troughs. The clamping elements shown in the form of a bolt 15 are located in the troughs 24 of the element 1. The spacing of the clamping elements from one another depends on the design and the loading of the support member. As a rule, however, the required number of clamping elements is smaller than the quantity of the troughs 24 in the surface 8, so that a noticeably smaller number of the clamping elements are required than in conventional built-up members. Compared to the conventional embodiments of built-up support members, it is possible in the present invention that the transmission means afford a reduction in the number of the clamping means required by 40% to 60%. Based on the dimensions of the support member, the design of the projections-recesses, and the expected loads and the required stiffness, the quantity of the clamping elements required can be determined and the clamping elements can always be positioned at the lowest points in the shaped facing surfaces of the lower separate element 1.

The built-up support element of the present invention can, in another embodiment, be in the form of a composite beam made up of two beam shaped elements, such as wooden elements, designed at the contacting facing surfaces between the elements with complementary projections and recesses and cooperating clamping elements.

In still another embodiment, the built-up support member can be formed of two panel shaped separate elements, with the shear transmission means of the present invention arranged in the form of a pair of thrust or shear strips located between the panels.

Figure 7:
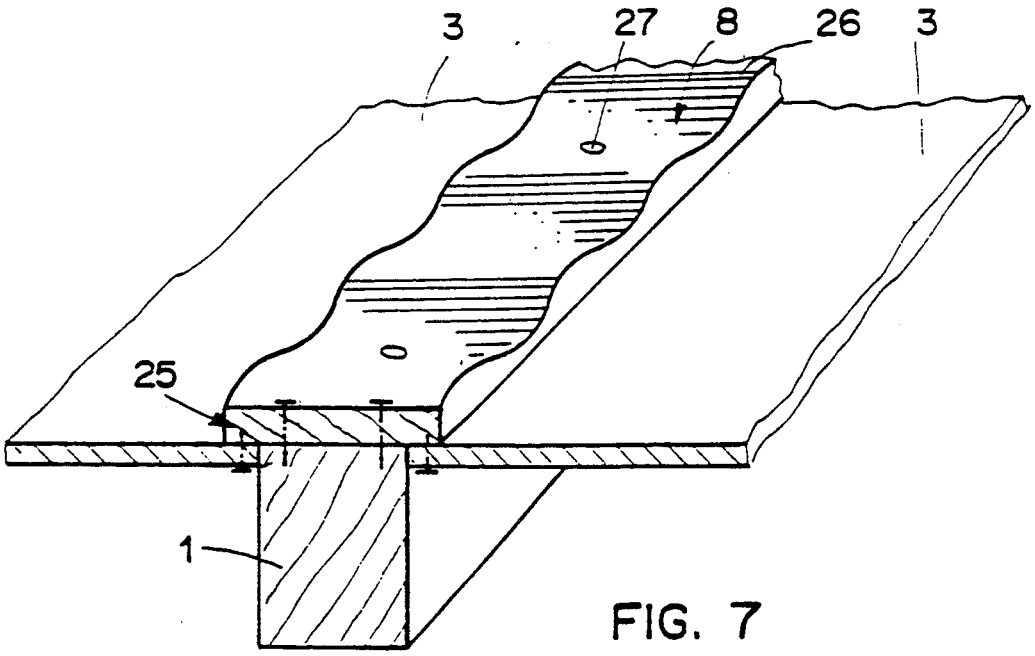
FIG. 7 is a perspective view of a built-up beam forming a part of the built-up support member of the present invention where the transmission of shear forces is effected by a shear or thrust member forming part of the beam and before the concrete of the panel-like element is poured.

In FIG. 7, an embodiment of the present invention is displayed where the built-up support member includes a thrust strip 25. First separate element 1 is in the form of a wooden beam and the second separate element 2, not shown, is a concrete panel. In FIG. 7, the support member is illustrated before the concrete has been poured. The wooden beam or element 1 includes the thrust or shear strip 25 secured to the beam. The connection can be formed by nailing, adhesive means or some similar means. In FIG. 7 the thrust strip 25 is also connected to the formwork panels or boards 3. Other arrangements are possible for securing the formwork panels 3. As an example, the formwork panels can be connected to the wooden beam 1. On its upwardly facing surface, thrust strip 25 has an undulating or wave-like profile forming the contacting surface 8 cooperating with the upper element 2. As mentioned above, in FIG. 7 the support member is shown before the concrete is poured for forming the upper element 2. The concrete for the upper element is poured on the upper surface of the formwork panels and, as a result, encloses the sides and the surface 8 of the thrust strip 25. Accordingly, the surface of the upper element contacting the thrust strip 25 has a shape complementary to the wave-like shape 26 of the strip. These complementary shaped surfaces are in contact with one another and provide the positive lock between the two separate elements of the support member after the concrete has set. As in the case of the embodiment described above, the clamping elements can be supplied in a non-prestressed or in prestressed condition. For this purpose bores 27 are located through the thrust strip 25 and are positioned at locations spaced from the lowermost point of the trough of the shaped surface 26. Clamping elements, not shown, would protrude from these bores and be concreted in the upper separate element 2 or protrude through the upper element. In such an arrangement the clamping elements can be prestressed on the opposite side, such as by a thread.

Figure 8:
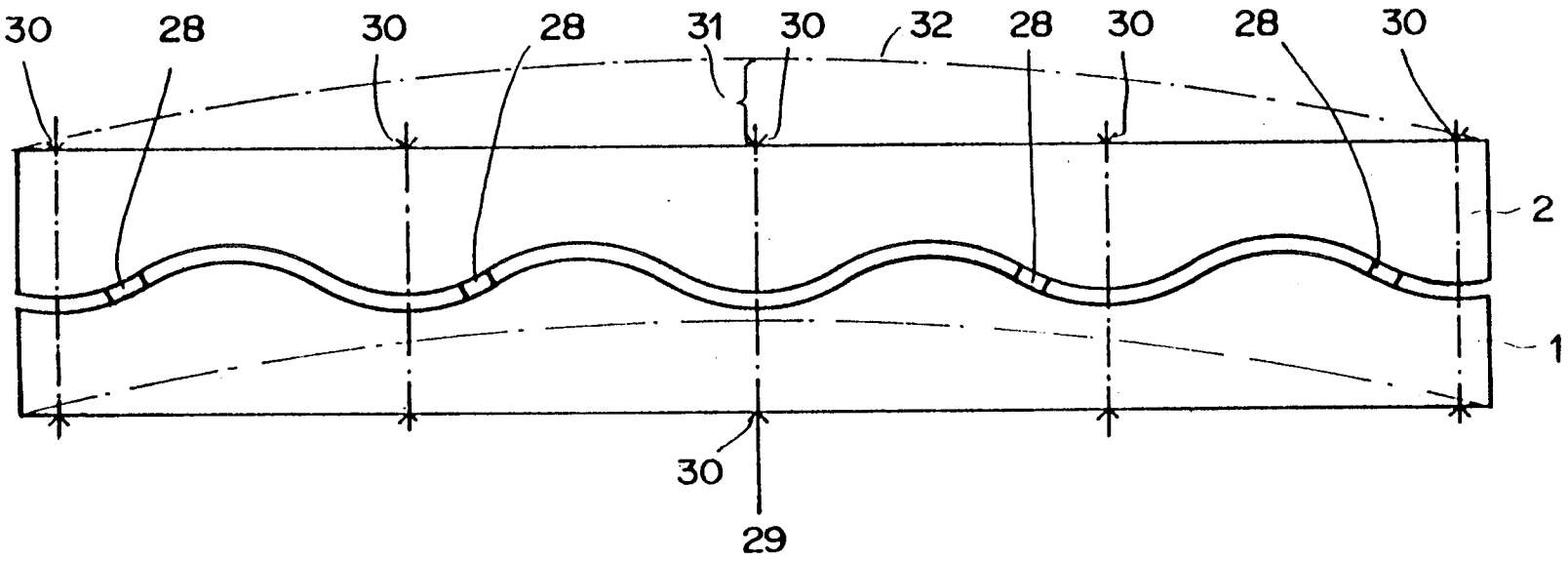
FIG. 8 is a schematic view of a built-up support embodying the present invention and equipped with spacers between the individual elements of the support member.

In FIG. 8 another embodiment of the built-up support member embodying the present invention is illustrated. In this embodiment, as above, the built-up support member is formed of two separate elements 1, 2. In this embodiment the individual elements are fabricated out of wood, however, other materials and shapes of the elements are possible. The cooperating surfaces of the separate elements 1, 2, previously in contact with one another, are shown in spaced relation and separated by spacer pieces 28. With reference to the lower element 1, the spacer pieces 28 are located intermediate the high point of the crest and the low point of the trough on the flank of the wave-shaped surface facing away from the center 29 of the beam. The spacer pieces 28 can be formed of soft metal, wood or plastics material. When clamping elements 30, shown diagrammatically, are prestressed, the compression force acting between the individual elements 1, 2 is transmitted not along the axis of the clamping elements 30, but rather offset from the axis and passing through the spacer pieces 28. Accordingly, a vertical force component acts relative to the separate elements I, 2 meaning that a tensile stress is produced in the upper element 2 and a compressive stress in the lower element 1. With this prestressing of the separate elements, the built-up support member has a camber 31 in the prestressed state. Such a camber is required if the upper surface of the support member is to be planar, and not curved, after the basic load has been applied.

While specific embodiments of the invention have been shown and described in detail to illustrate the application of the inventive principles, it will be understood that the invention may be embodied otherwise without departing from such principles.

I claim:

1. A built-up support member for carrying bending loads formed of two coacting load carrying separate elements (1, 2) one superimposed on the other, with the separate elements (1, 2) absorbing normal forces caused by bending, said separate elements having facing surfaces, first means for transmitting shear forces acting at the facing surfaces between the separate elements (1, 2), said first means comprising that said facing surfaces have complementary shaped surfaces comprising projections and recesses, second means for applying prestressing force between said separate elements with said second means extending transverse said facing surfaces, said complementary shaped facing surfaces being one of rounded surfaces or obliquely disposed surfaces, said separate elements (1, 2) comprise an upper element (2) superimposed on a lower element (1), said upper element having an upper planar surface opposite said facing surfaces, said lower element having a second surface opposite said facing surfaces, said second means comprises clamping means extending between and bearing against said upper element (2) and said second surface of lower element (1) at least at one of said projections and recesses, and said clamping means extending perpendicularly of said upper planar surface.

2. A built-up support member, as set forth in claim 1, wherein said facing surfaces (8, 9) being contacting surfaces, and said upper element (2) having projections (11) thereon extending into recesses (10) in said lower element.

3. A built-up support member, as set forth in claim 1, wherein said lower element comprises a beam-like member having an upper surface and a thrust strip secured to the upper surface of said beam-like member, said thrust strip forming the facing surface of said lower element, and said thrust strip having at least one of said projections and said recesses formed in the facing surface thereof, and said thrust strip secured to said beam-like member.

4. A built-up support member as set forth in claim 1, 2 or 3, wherein said upper element comprises a dead load acting on said lower element (2) and said dead load comprises the weight of said upper element (2).

5. A built-up support member, as set forth in claim 4, wherein said upper element (2) is formed of concrete.

6. A built-up support member, as set forth in claim 1, wherein said clamping means (15, 18) includes a bolt securing said upper and lower elements together and means acting on said bolt and on one of said upper and lower elements for applying a prestressing force on said upper and lower elements (1, 2).

7. A built-up support member, as set forth in claim 1 wherein said complementary facing surfaces are in spaced relation with spacer pieces (28) located therebetween and in contact with said facing surfaces, said lower element having a long dimension, said facing surfaces of said upper and lower elements having a wavelike configuration extending in the long dimension with alternating crests and troughs, said lower elements having a center point in the long direction of said facing surface, said wave-like facing surface of said lower element having a plurality of flanks with some of said flanks facing toward the center and others facing away from the center, and said spacer pieces (28) being located on the flanks of said troughs facing away from the center point and positioned between and spaced from a high point of the crest and a low point of the trough of the wave-like facing surface of said lower element.

8. A built-up support member as set forth in claim 1, wherein said clamping means comprise bolts extending from said upper element into said lower element, and Belleville springs acting on said bolts for applying the prestressing force to said upper and lower elements.

9. A built-up support member as set forth in claim 4, wherein said second means includes bolts extending through said upper element and said lower element in the region of the projections and recesses.

* * * * *